US007334798B2

(12) United States Patent
Halliburton

(10) Patent No.: US 7,334,798 B2
(45) Date of Patent: Feb. 26, 2008

(54) CRANE AMUSEMENT GAME WITH VERTICALLY ADJUSTABLE PLAY FIELD

(75) Inventor: Ronald D. Halliburton, Delray Beach, FL (US)

(73) Assignee: Benchmark Entertainment L.C., Hypoluxo, FL (US)

( * ) Notice: Subject to any disclaimer, the term of this patent is extended or adjusted under 35 U.S.C. 154(b) by 0 days.

(21) Appl. No.: 10/542,402

(22) PCT Filed: Sep. 18, 2003

(86) PCT No.: PCT/US03/29648

§ 371 (c)(1),
(2), (4) Date: Apr. 24, 2006

(87) PCT Pub. No.: WO2004/026415

PCT Pub. Date: Apr. 1, 2004

(65) Prior Publication Data

US 2006/0255544 A1 Nov. 16, 2006

Related U.S. Application Data

(60) Provisional application No. 60/411,368, filed on Sep. 18, 2002, provisional application No. 60/411,901, filed on Sep. 20, 2002.

(51) Int. Cl.
*A63F 7/36* (2006.01)

(52) U.S. Cl. ..... 273/447

(58) Field of Classification Search ..... 273/447, 273/448, 440, 441, 454
See application file for complete search history.

(56) References Cited

U.S. PATENT DOCUMENTS 5,415,417 A * 5/1995 Reis, Jr. ..... 273/447
5,967,892 A * 10/1999 Shoemaker, Jr. ..... 463/7
6,598,881 B1 * 7/2003 Shoemaker, Jr. ..... 273/447

* cited by examiner

*Primary Examiner*—Raleigh W. Chiu
(74) *Attorney, Agent, or Firm*—Venable LLP; Andrew C. Aitken

(57) ABSTRACT

This invention relates to coin-operated amusement games referred to as cranes. Cranes have a plurality of prizes that are distributed across the play field of a container that has a claw or other engagement device suspended above the prizes. A player remotely controls the location of the claw above the prizes to a desired location and the claw is then lowered toward the prizes. The play field surface on which the prizes are distributed can be vertically moved as the prizes are withdrawn to maintain the appearance that the container is substantially full of prizes. The drive mechanism that moves the play field surface includes a motor coupled to an drive belt that drives a threaded nut. As the nut is driven, opposite threads on a threaded rod are engaged and the rod is caused to move upward or downward. One end of the threaded rod is received in a bushing on the bottom surface of the play field surface. The invention also includes a motor for rotating the claw with respect to the play field surface and air powered claw device.

8 Claims, 10 Drawing Sheets

CRANE AMUSEMENT GAME WITH VERTICALLY ADJUSTABLE PLAY FIELD

The Applicant claims the benefit of U.S. application Ser. No. 60/411,368 filed Sep. 18, 2002, U.S. application Ser. No. 60/411,901 filed on Sep. 20, 2002 and International Application No. PCTUS2003/029648 filed on Sep. 18, 2003.

BACKGROUND OF THE INVENTION

This invention relates to improvements for coin-operated amusement devices generally referred to as cranes. Cranes are characterized by an enclosure having a transparent window that allows a player to observe a play field on which prizes are randomly distributed across the surface. Over the play field area is situated a claw or other device that is designed to engage the prizes. In conventional arrangements, the claw is suspended from a chain or cable and, upon activation of the device, an operator can remotely move the claw to a desired position above a selected prize on the play field. The claw is then opened, lowered into the proximity of prizes and then closes. In the event that the claw engages a prize, it is transported to a retrieval area.

Conventional crane devices are often located in arcades, stores, game rooms, shopping malls and amusement parks. Most crane games consist of a large container that has windows so an operator can see the array of prizes and manipulate the location of the claw. The prizes typically include a wide assortment of different toys such as plush items, candy, balls or other collectables. With conventional cranes, a player typically operates a joystick control to manipulate the claw over the desired prize area by activating motors that drive a carriage that holds the claw. The tracks, which are typically oriented perpendicularly to one another, are attached to the ceiling of the container. When the player is satisfied with the location of the claw, the player may depress a switch to activate a motor that causes the claw to be opened and lowered where it may possibly engage any prizes that it may contact. The claw then closes, is raised back up and is automatically moved to the prize retrieval area. When the claw is over the retrieval area, the claw is then again opened and, if the claw had successfully engaged a prize, it will release the prize where it is allowed to drop into a retrieval area that can be accessed by the player.

In another common game procedure, the player is permitted a predetermined time in which to position the claw. When the time has elapsed, the claw will open and drop from whatever location it occupied. In this procedure, in the event that the player does not activate the lowering sequence within the predetermined time, the claw is automatically opened, lowered and the same sequence as outlined above progresses. While a joystick is the most common controller used for crane games, other input means such as switches, pressure activated buttons or roller balls may also be used to control the movement of the claw. Conventional crane games use DC motors to orient the claw over the prizes and drop the claw down in proximity with the prizes. These conventional games also use a solenoid to open and close the arms of the claw. The use of a solenoid to control the arms of the claw has a number of disadvantages: the part must frequently be replaced due to wear, with use the coils of the solenoid heat up causing the solenoid to lose power and, the power curve is not evenly distributed along the stroke of the piston wherein the torque available at the end of the stroke is different than the beginning. Further, the torque curve of a solenoid cannot be adjusted. The use of solenoids to power the claw also requires running a power source to the motor and therefore require at least two wires or cables to be suspended from the overhead track or boom. The presence of multiple wires on the increases the chances of entanglement and these problems are a major contributor of service calls on conventional crane devices.

Because the prizes are depleted, someone having access to the prize container must periodically replace prizes in conventional crane games. If the game is frequently played, the prizes must be more frequently replaced. If the number of prizes in the game appears depleted, players will not have a large selection of prizes and accordingly, play on the game may decrease. In some circumstances, certain types of prizes are more popular than other items and these popular prizes will be more quickly depleted because players will target such items. If the number of popular items appears depleted, play on the game may also decrease. Yet a further problem with conventional crane games is that prizes are typically withdrawn from the middle portion of the container at a more frequent rate than from the periphery. This leaves an inconsistent distribution of prizes on the play field. In any event, any manner in which one could reduce the frequency of checking the container and filling the container would be a welcome improvement to owners of crane games.

As discussed above, after frequent play, the distribution of prizes on the play field may become uneven. The action of the engagement of the claw on the items also causes the prizes in the container to settle and to become closely nested adjacent to one another. When the prizes settle in the container in this manner, they are more difficult to be engaged by the claw device. In these circumstances, players may become frustrated with the play of the game and become less inclined to play or continue to play the game.

Although cranes can be used to distribute a variety of prizes, the manner of engagement of the prize is affected by the characteristics of the items that are being manipulated. For example, materials that are plush are resilient and will partially deform in response to the engagement by the claw. Other prizes may be rigid and will not compress or conform to the pressure that is exerted by the claw. In view of the diverse types of prizes that may be distributed in the games, it would be desirable to be able to more precisely control the pressure that is exerted by the claw in order to match the characteristics of the prizes that are in the container. Further, if the pressure that the claw exerts on the prize is increased, the chances that the claw will successfully engage, lift and retain a prize as it travels to the retrieving area is increased.

Conventional crane games allow a player to position the claw on two perpendicular tracks. Most games use DC motors that are activated in response to the joystick to position the claw over the prize field. While the player can position the claw over the prize, in conventional cranes the player does not have any control over the angle or orientation of the claw with respect to the prize. In the absence of such control, some players may become frustrated playing the game because it is difficult to stop the movement of the claw at the precise spot they have selected. Further, because the movement is limited to two tracks, the player does not have an option to rotate the orientation of the claw with respect to the prize. Accordingly, there is a need for improved player control of the claw during the claw orientation sequence.

SUMMARY OF THE INVENTION

The present invention is directed to improvements for crane games that may lead to increased satisfaction by the user and therefore additional play. One of the improvements is to provide a prize container with a surface or play field that can be moved vertically within the container to either increase or reduce the capacity of the container. In this arrangement, the prizes can be raised as the number of prizes in the device is depleted. The surface may be raised (1) in response to an optical sensor that detects the level of prizes in the container, (2) in response to the detection of a predetermined number of prizes that have been removed, or (3) based upon the input from the motor that controls the lowering and raising of the claw device. The surface may also be raised or lowered by a switch that is accessible to the owner or operator of the device.

Additional improvements disclosed herein include (1) a vertically adjustable surface that enables the surface on which the prizes are located to be moved, (2) stepper motor control for the orientation of the claw device over the prize field, (3) a maintenance mode wherein the claw will systematically engage prizes on the field to fluff the prizes and thereby prevent settling, (4) an air-powered claw engagement device, and (5) a third control axis that enables the player to rotate the claw with respect to the prize surface. The detailed description of the invention and drawings that accompany this application set forth other features of the invention.

By moving the play field surface upward, the game unit gives the appearance that the container is full of prizes. The operation can be performed either by a user initiating the surface adjustment, or automatically using sensors that detect the prize level and initiate the operation when the prize level falls below a predetermined elevation or other criteria. The operation is preferably performed using a drive system located below the container's play field surface that raises and lowers the surface continuously or incrementally with a stepper motor or a screw-drive system. In a preferred embodiment, the drive system comprises a motor that drives a belt or chain member to rotate a plurality of support rods. The support rods are threaded and cooperate with opposite threaded hexagonal nuts so that rotation of the nuts imparts a vertical movement on the threaded support rods, which in turn moves the play field in a vertical direction.

DETAILED DESCRIPTION OF THE PREFERRED EMBODIMENTS

Figure 1:
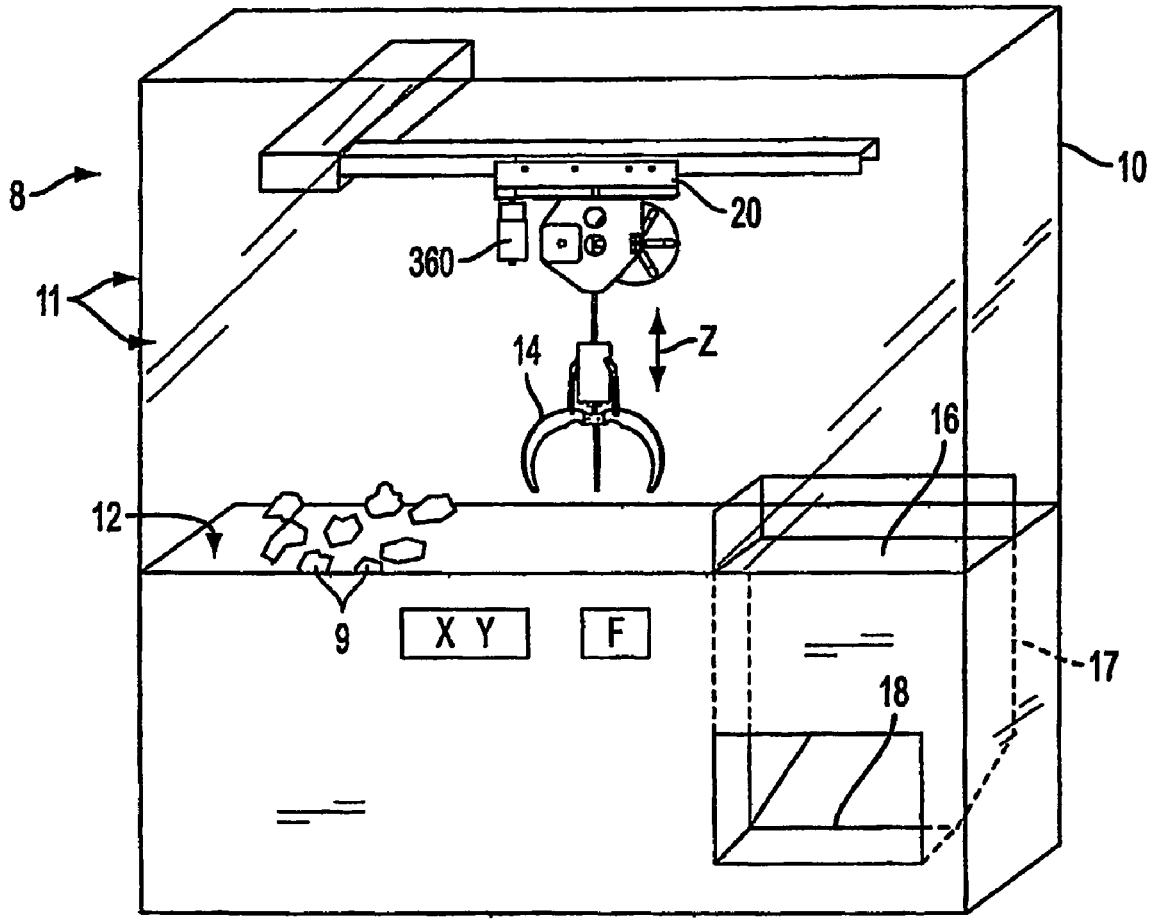
FIG. 1 is a perspective view of a crane device generally depicting a crane device to which the invention is directed.

The present invention is directed to improvements for cranes such as that depicted in FIG. 1. Depicted in FIG. 1 is a game unit 8 which has an enclosed container section 10 incorporating transparent windows 11 that allow a player to see prizes distributed across a prize play field 12 and a moveable claw 14. Claw 14 is suspended from a carriage 20 that is mounted near the ceiling of container section 10. Passage 16 through play field 12 leads to chute 17 that leads to retrieval area 18 that provides a player access to any prizes that have been successfully removed from the play field 12 by claw 14. In a preferred embodiment, conventional anti-tampering devices are employed to prevent tilting the machine to cause prizes to fall into the chute.

Figure 2:
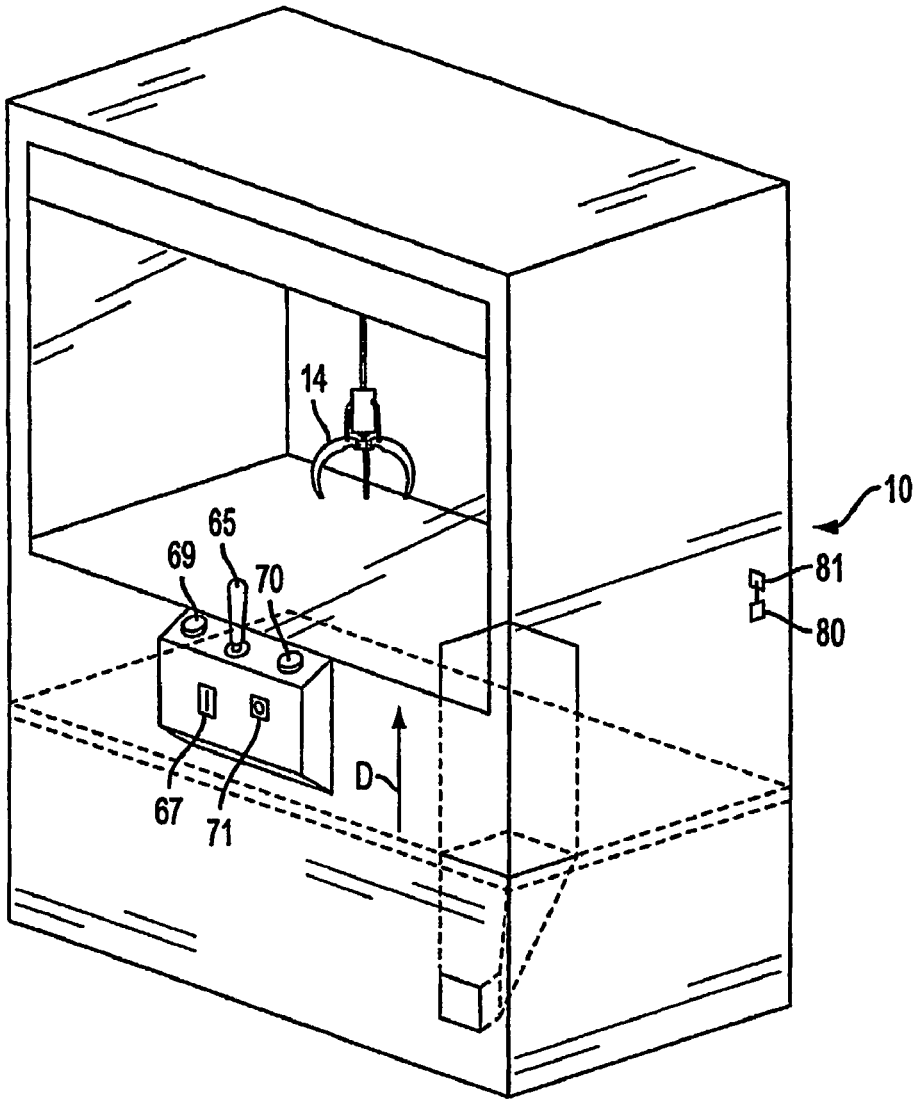
FIG. 2 is a view, partially cut away, of a crane game depicting the play field surface at two positions within the lower portion of the cabinet of the device.

As seen in FIG. 2 the play field 12 is designed to vertically move within the lower portion of the game unit 8 a predetermined distance D. Also shown in FIG. 2 is prize level optical sensor consisting of a light source 80 opposite photo detector 81. In a preferred embodiment, light source 80 emits an infrared light beam toward photo detector 81. In the event that the light beam is interrupted by prize items within the container, no signal is sent to the CPU from photo detector 81. When the level of prizes has been depleted, light may impinge on photo detector 81 and a signal is sent to the CPU. The CPU can then activate motor 101 to elevate play field 12. Play field 12 may be elevated a predetermined distance or it may be elevated until the signal from photo detector 81 is interrupted. In preferred embodiments a plurality of optical sensors are used at different locations on the device and the signals are sampled at predetermined times. Based upon this input, (and other input such as the last time that the play field was elevated or the number of times the game has been played,) the CPU runs a program to determine if the play field should be elevated. Alternatively, the actuation of the motor can be dependent on the number of successful extractions of prizes. Once again, the game may employ optical sensor within chute 17 that provides a signal to the CPU each time a prize item interrupts the signal. For example, after every ten detections that a prize has been distributed through chute 17, the play field 12 is raised a predetermined distance by activation of motor 101.

The control of the claw is performed by joystick controller 65 that provides for the activation of stepper motors that allow the claw to be positioned at the desired location over the play field. Switches 69 and 70 provide signals to operate the claw rotation motor 360 in opposite directions. These controls allow a player to adjust the orientation of the claw with respect to the play field. Also provided on the front of the game unit is a conventional coin acceptor 67 having a coin slot and a credit switch 71 for the initiation of play of the game.

Figure 4:
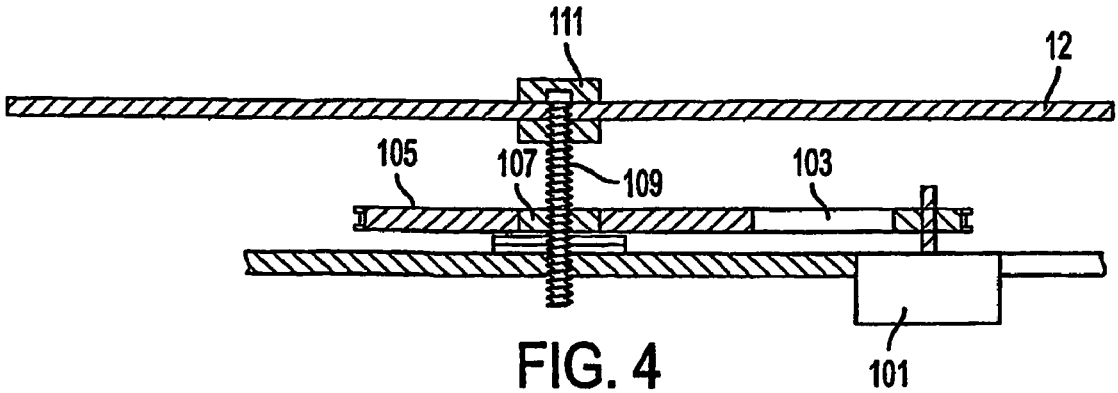
FIG. 4 is a view in elevation of the drive mechanism for raising and lowering the play field.
Figure 3:
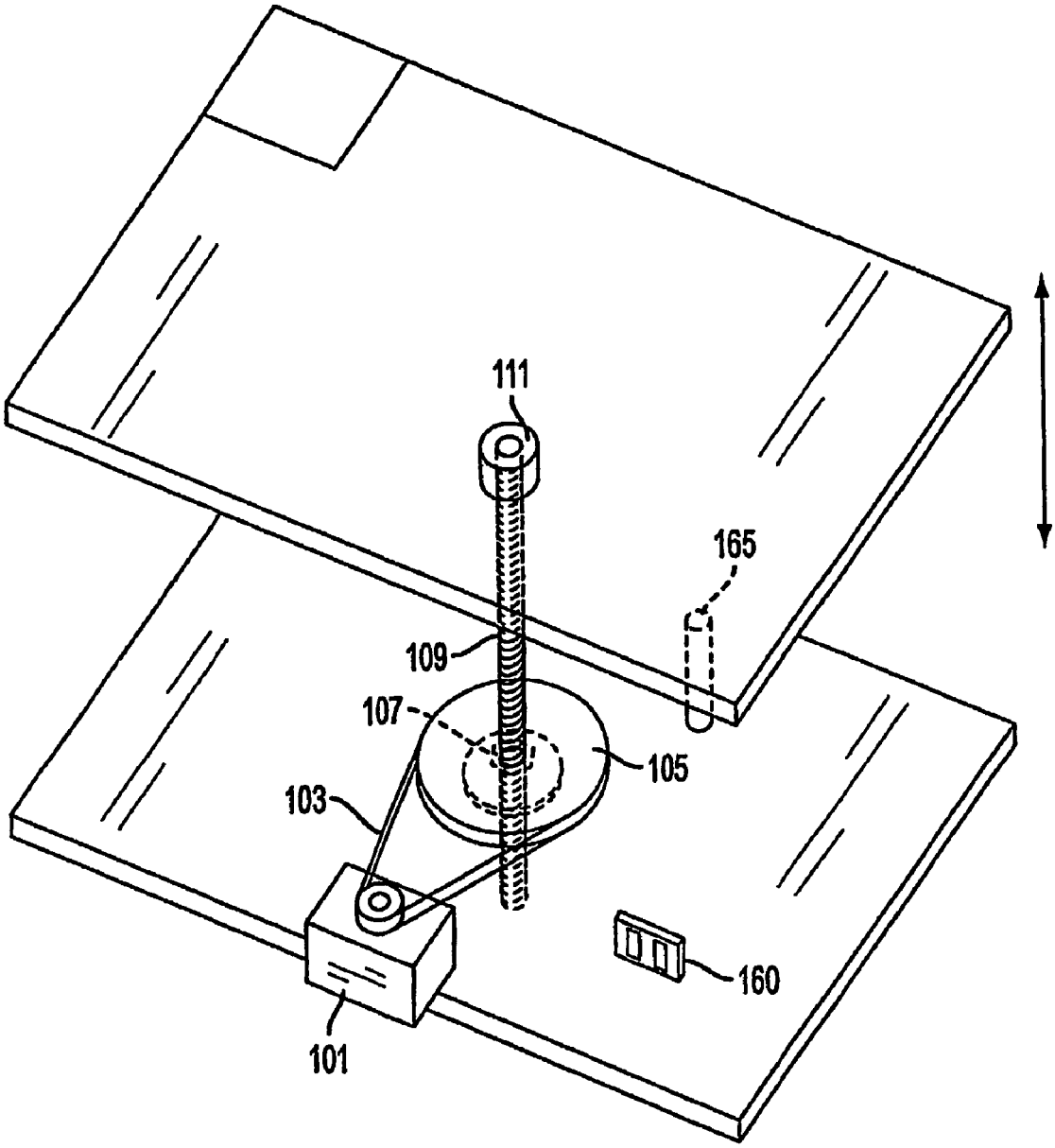
FIG. 3 is a perspective view of the drive Mechanism for raising and lowering the play field.

As best seen in FIGS. 3 and 4 the drive system for adjusting play field 12 in the game consists of motor 101 that drives belt 103, which in turn drives pulley member 105. The rotation of the pulley member 105 is transferred to hexagonal nut 107 that rotates and engages opposite threads on threaded rod member 109. As the threads of the rod member 109 rotate through hexagonal nut 107, the rod member 109 travels upwards or downwards, depending on the direction of travel of motor 101. Motor 101 is controlled by a central processing unit. The threads on the surface of the annular opening of hexagonal nut 107 engage opposite threads of the threaded rod 109 to translate the movement. Rotation of nut 107 in a first direction raises the rod 109 and rotation in the opposite direction lowers play field 12. The top of the threaded rod member 109 is received in bushing 111 that is attached to the bottom surface of play field 12 and accordingly, the threaded rod generally supports the play field. The top surface of the play field supports prizes (not shown) that may be viewed by the player through a window provided in the front of the cabinet.

While in the preferred embodiment a hexagonal nut having internal threads is driven that translates its rotational motion to rectilinear motion of the vertical oriented threaded rod, it is contemplated that alternative arrangements could be employed to raise and lower the play field floor. For example, a motor could be coupled to a rod that translates motion to a threaded coupling that is attached to a play field. The play field could also be driven by a plurality of motors that drive endless belts or gears oriented in a vertical direction. Other methods of effecting vertical movement to a planar surface are diverse and well known.

Optical sensor 160 is located on the interior wall of the bottom of the unit 8 that detects extension 165 that is affixed to the bottom surface of the play field 12. When the extension is opposite sensor 160 a signal is generated and transmitted to the CPU or controller indicating the level of the play field. The signal may indicate that play field 12 is at the lowermost or uppermost position. The optical sensor consists of a light source, reflector and a photo detector. Light is emitted from the source and may be reflected from reflectors positioned on the extension 165. Because the play field motor 101 is a stepper motor, the position of the play field 12 may be tracked by the CPU based upon a count of its output signals that control the motor.

In a preferred embodiment the level of the prizes is determined during a maintenance mode when play is not permitted. The claw is dropped approximately ten times at different locations across the play field. The claw optical sensor 860 in combination with the count of the reel motor 304 determines the distance of each drop. Then the play field 12 is raised to a level determined by the CPU based upon the average drop distance. In an alternative procedure, the play field is elevated to the lowest drop distance.

While in the preferred embodiment only the single threaded screw is required to support play field 12, it is contemplated that play field 12 could be further stabilized and supported by vertical rails on which the floor would ride. For instance, a play field could be provided with a plurality of gears that engage opposite teeth provided on vertical rails that would serve to further support the periphery of the play field surface. It is further contemplated that a plurality of threaded rods could be used, each of which can be driven by a motor. As a player extracts prizes from the container, the adjustment system will elevate the play field so that the container section 10 always appears full of prizes. Using the system allows less frequent visits to the game by the game owner or operator to restock prizes. When it is time to fill the container, the operator or owner of the game will activate a switch to cause the motor to lower the play field surface to the bottom or lowermost position. Then the new prizes are added to the game.

Figure 5:
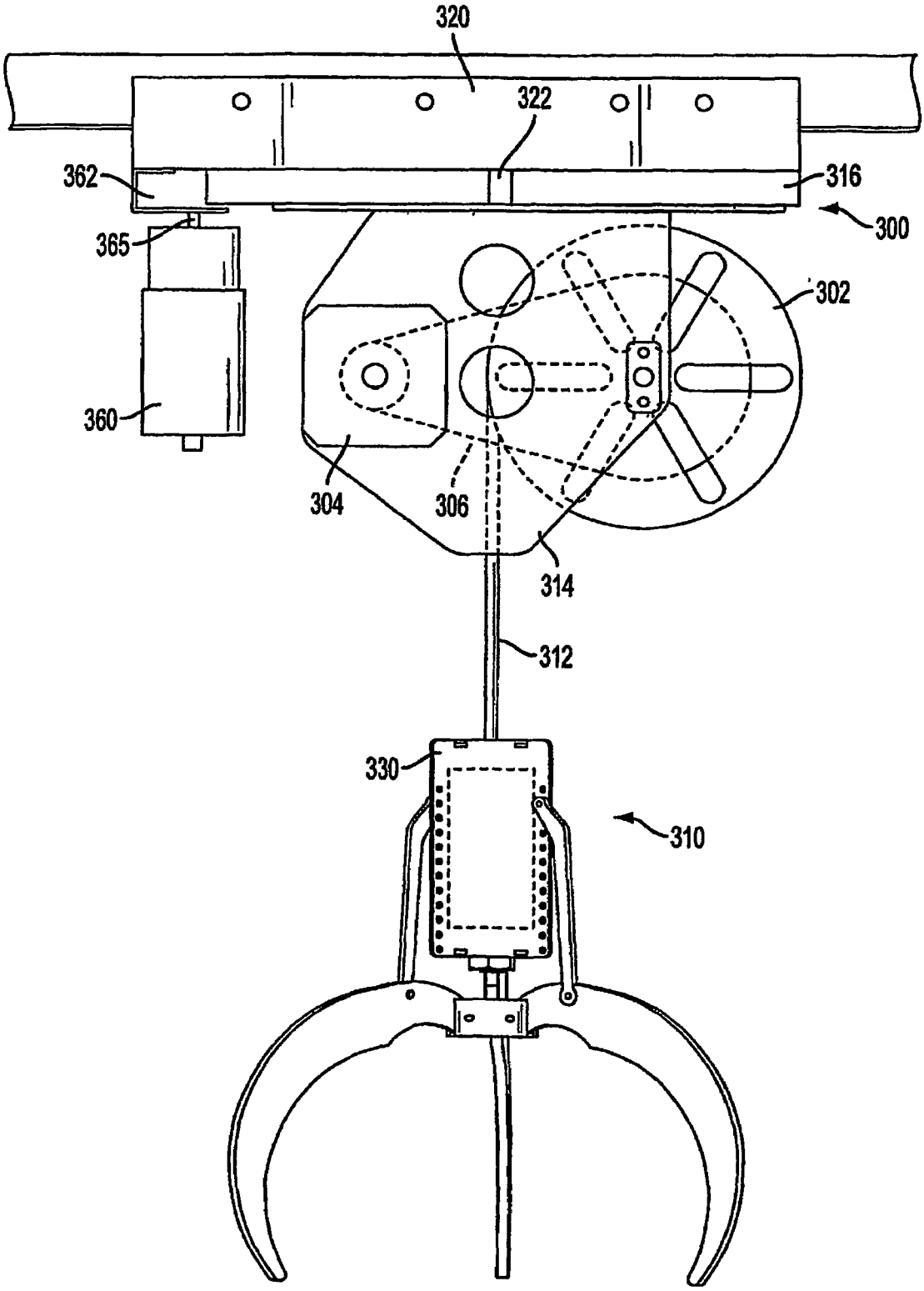
FIG. 5 is a view in elevation, in partial section, of the carriage that provides for limited rotational movement of the claw feature.

Now referring to FIG. 5, claw 14 is suspended from assembly 300 that includes the reel 302, reel motor 304, drive belt 306 and the claw assembly 310 that is suspended by a hollow tube or hose 312. Reel motor 304 is mounted on bracket 314 which is coupled to pivot wheel 316 by drive wheel 362. The entire assembly 300 is attached to carriage 320 by central pivot 322. One end of the hose 312 is attached to air cylinder 330 within the claw assembly. Hose 312, which suspends claw assembly 310 is wound upon reel 302 and then exits reel 302 near the center of the reel (not shown), and extends to an air pump. The assembly 300 can be moved with respect to the carriage about pivot 322. Extending from stepper motor 360 is shaft 365 that drives a wheel 362 which is in frictional engagement with larger wheel 316. The activation of the motor 360 is controlled by switches 69 and 70. When the motor is activated, the coupling will advance the wheel a predetermined distance in a first direction. Each time the button 69 is activated the motor will receive a signal from the CPU to sequentially advance the motor one step. Activation of switch 70 advances motor 360 one step in the opposite direction. The rotation of wheel 316 is limited to approximately 60 degrees. In alternative embodiments, the wheel may be engaged by opposite gears that are meshed together or by a drive belt. Activation of motor 360 allows for limited rotational movement of the entire assembly 300 about central pivot 322. Rotation is restricted to approximately 60 degrees, in part because the hose 312 and power supply for motor 360 would be wound up if the rotational movement was not restricted. In this regard, free rotation is impeded by the cables required to activate and control motor 360 and the hose 312, which is routed to an air pump located in the bottom of the unit.

Figure 6:
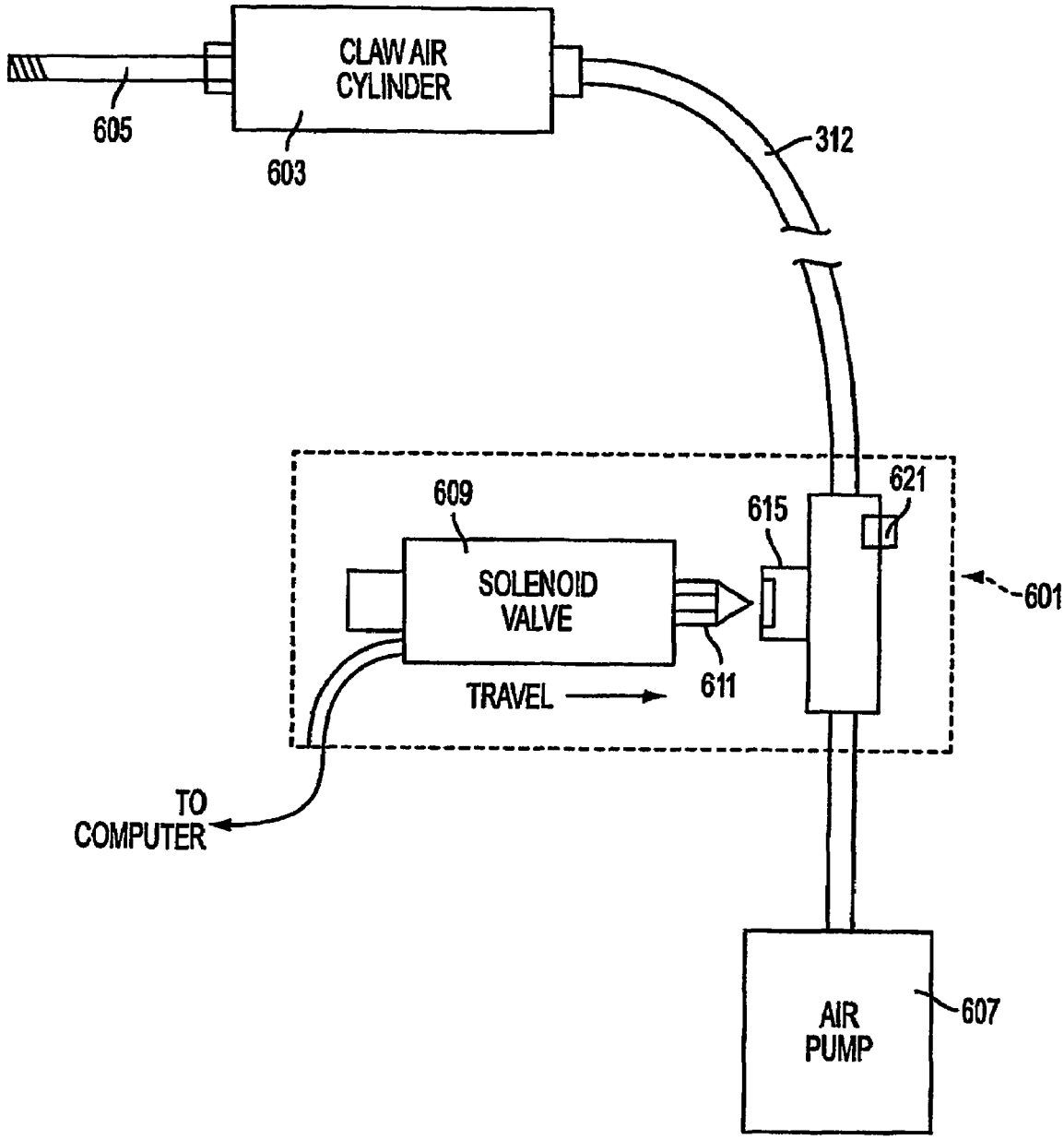
FIG. 6 is a schematic of the air-powered cylinder that activates the claw.

Now referring to FIG. 6, on one end of hose 312 is an air cylinder 603 having a piston 605 extending from one end. The opposite end of hose 312 is connected to air pump 607. Hose 312 exits reel near the center and connects to air pump 607, that is located in the unit below the play field surface 12. The pressure in the hose is regulated by solenoid valve 609. In response to a signal from the CPU 400 a piston 611 moves from the solenoid to engage valve 615 that causes pressure in the system defined by the air cylinder, the hose and air pump, to be released.

Figure 7:
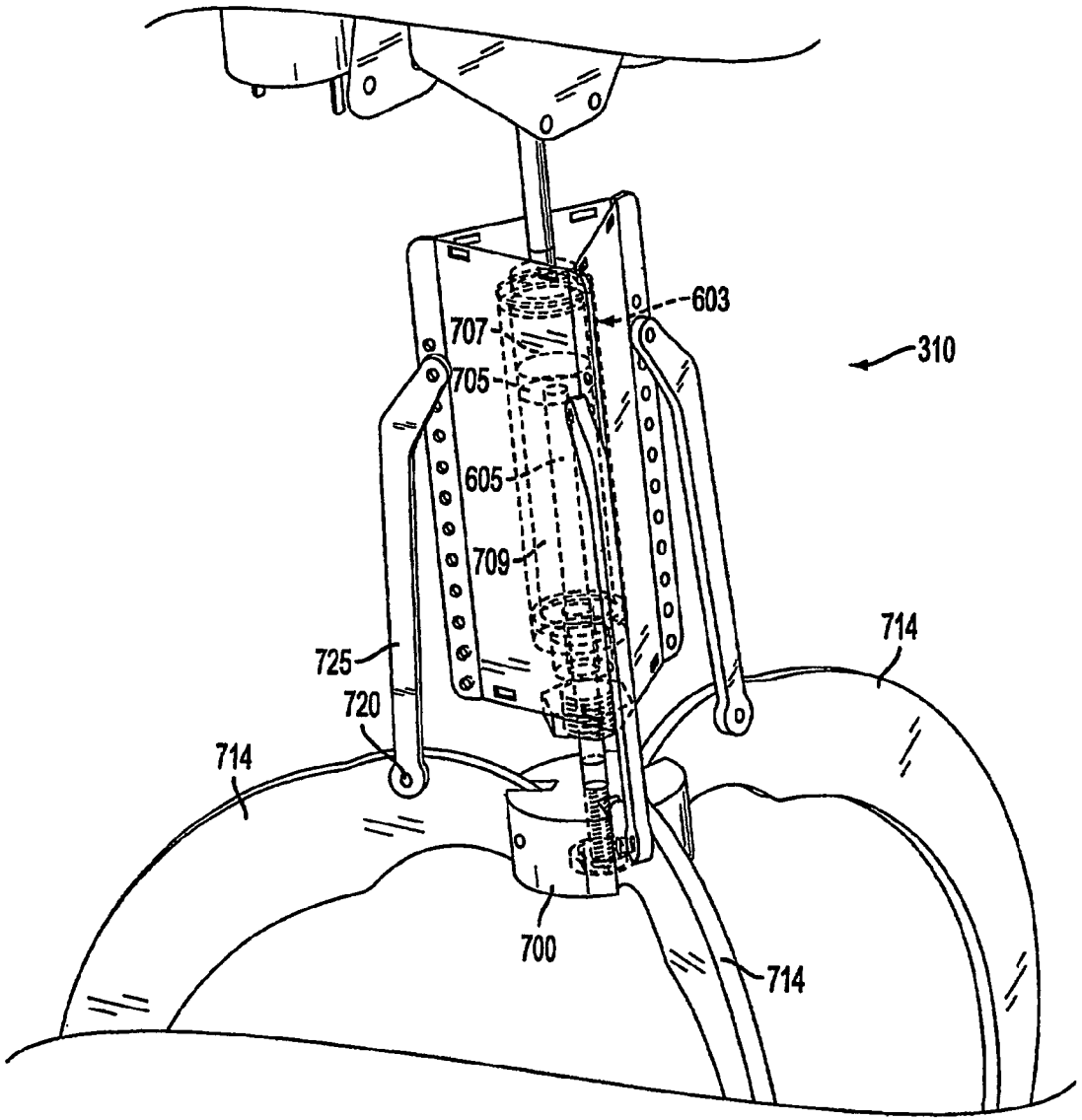
FIG. 7 is a perspective view of details of the claw member showing the air cylinder structure in phantom.

As best seen in FIG. 7, when reel motor 360 is first activated, the piston 605 is shown extending from cylinder 603 causing the arms of the claw to be in an open position. The reel 302 lowers the claw down towards the prizes and, when the claw is in close proximity to the prizes, or comes into contact with one of the prizes, a signal is sent to the CPU which in turn activates air pump 607. Air pump 607 causes air pressure to build up in the system and causes chamber 709 to expand to force end wall 705 upwards. Because piston 605 is attached to end wall 705 it retracts into air cylinder 603. The opposite end of piston 605 is attached to claw control member 700 which pulls the three proximal ends of the arms 714*a*. 714*b* and 714*c* upwards and towards the cylinder 603. As the proximate ends of arms 714*a*, 714*b* and 714*c* are pulled upwards, the arms pivot on point 720 and the distal ends of the arms are drawn together and close. Pivot point 720, at the end of the support members 725 is at a medial location on arm 714. Next, the CPU sends a signal to reel drive motor 304 to reverse direction and the claw is transported up and over passage 16 through the play field surface by motors 501 and 502. When claw 14 is above the passage 16, the CPU sends a signal to the solenoid valve to open and the air pressure within the system is released. The release of pressure allows the piston to drop from the air cylinder and the arms of the claw are allowed to open. In the event that the claw successfully engaged and transported a prize to the retrieval area, it will be released and directed to access area 18.

Employment of air cylinder 603 to operate the arms of the claw has a number of advantages over the prior art. By using an air cylinder, the pressure or torque applied to the arms is evenly distributed along the entire stroke of the piston. This feature is advantageous when using a crane with a diverse array of prizes. For example, an air powered claw would be more effective at picking up a prize with larger dimension than a claw controlled by a solenoid because it would be able to apply the same amount of pressure to the prize when the claw is at a substantially open position as when it is substantially closed. In contrast, a claw operated by a solenoid would not be able to apply equal amounts of pressure at these two positions. Further, by altering the pressure in the system by adjusting the bleed value to the desired pressure ("PSI"), the torque or pressure exerted by the arms can be adjusted. This feature is particularly useful in helping affect the feature of the present invention where the prizes are periodically engaged and then dropped to fluff the prizes and make the distribution of the prizes on the play field less dense. Further, a high torque engagement can be used in an attract mode wherein the CPU can be programmed to repeatedly engage prizes using a very high torque adjustment and then drop them within the play field. By being able to adjust the torque of the arms, the operator can also adjust the relative difficulty of the game. Air cylinders have very long useful lifetimes in comparison with solenoids and provide superior performance. An air cylinder can be continuously and repeatedly used for long periods without exhibiting adverse effects such as heat build up that adversely effect the performance. Since the air hose both suspends the claw and serves to deliver air to the cylinder that controls the motion of the arms, the claw can be suspended from the track or boom from a single element. This arrangement results in reduced problems and service call in comparison with claws that are powered by solenoids because the hose will not become entangled.

As discussed above, arms 714*a*, 714*b* and 714*c* remain extended and the claw is open until a signal is received from claw position sensor 860. Claw position sensor 860 is a pressure sensitive switch that detects when the load has been removed from the claw. When the load is removed from the claw, a spring which has been biased by the weight of the claw assembly 300 moves to impede the passage of light from impinging on a photodetector. A signal is transmitted from the photodetector to CPU 400 which then sends a signal for the claw to begin the engagement sequence described above and the reel motor 304 to reverse. In an alternative embodiment, the position of the claw is detected by a shift in voltage from the stepper motor 304 indicating that the claw has come into contact with the prizes on the play field. Alternatively, the impact of the claw on the prizes can be determined by counting the steps of the motor that cause the hose to unwind from the reel and comparing it with prize level floor that has been optically detected by an optical sensor 800, or directly detecting the engagement using optical sensors on the claw device.

As discussed above, in response to a signal that the claw is in engagement with the prizes, CPU 400 sends stepper motor 304 a signal to reverse direction and thereby reel up the hose on which claw 310 is suspended. At about the same time that stepper motor 304 receives the signal to reel up the hose 312, another signal is sent to the X and Y stepper motors 501 and 502 to activate the motors and transport the claw carriage to the grid coordinate matching the prize retrieval area. When the claw is in position over the retrieval area the CPU sends a signal to solenoid valve 609 to open and thereby release pressure in the system. As pressure in the system dissipates, the piston extends from the cylinder and arms 714 are allowed to open and release any items therein. While in the preferred embodiment the arms will open due to gravitational forces wherein the piston falls on the member 700 and causing the arms to open, it is contemplated that the arms may be spring loaded so as to impose additional force.

A bleed value 621 is also provided which serves to regulate the maximum air pressure in the system, this bleed valve 621 can also controlled by the CPU or may be manually controlled to alter the performance of the claw. For instance in the maintenance or attract mode, the bleed valve may be set to increase the pressure so that the claw torque is increased with respect to the pressure setting during play.

Figure 8:
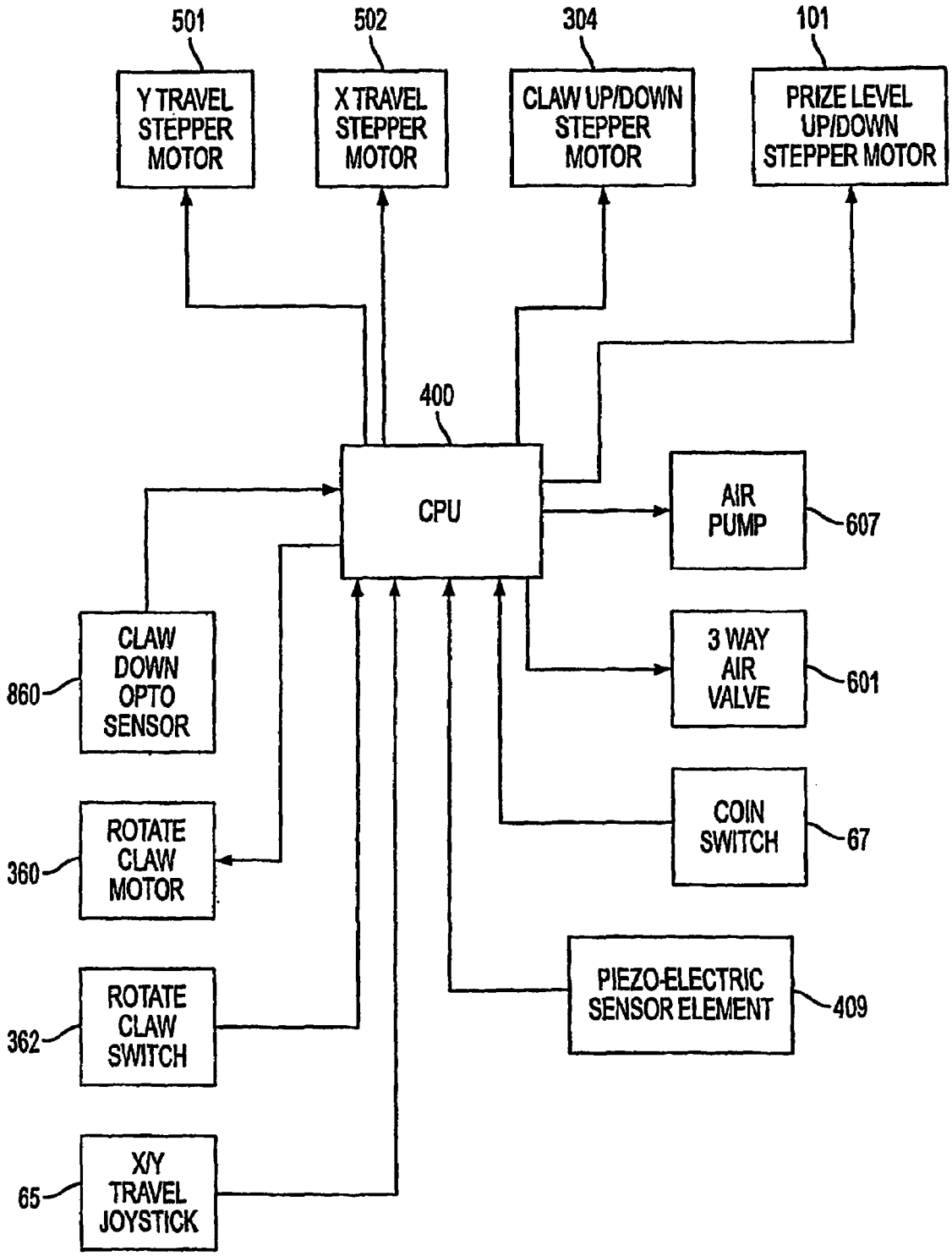
FIG. 8 is schematic drawing depicting the controller and its respective input and output devices.

Now referring to FIG. 8, the actuation of each of the motors is performed by central controller or central processing unit 400. As referred to above, CPU 400 may activate play field adjustment motor 101 based upon criteria stored in the processor's memory or based upon input from game sensors. In a first embodiment, motor 101 is actuated and driven in a first direction in response to a signal from an optical sensor 79 that detects the prize level of the container section 10. When the prizes have been depleted, the reflector will not reflect back light to an optical sensor (or allow light to be sensed by a photo detector) from a light beam that passes across the play field at a fixed predetermined height or level. In this regard, the optical scanner may be located opposite the sidewalls of the container or upon adjacent sidewalls wherein the light is directed from the source to the detector across the container. Actuation of each of the motors is performed by central controller or central processing unit 400. As referred to above, CPU 400 may activate play field adjustment motor 101 based upon criteria stored in the processor's memory or based upon input from game sensors. In a first embodiment, motor 101 is actuated and driven in a first direction in response to a signal from an optical sensor 79 that detects the prize level of the container section 10. When the prizes have been depleted, a reflector positioned in the container will reflect back light to an optical sensor (or allow light to be sensed by a photo detector) from a light beam that passes across the play field 12 at a fixed predetermined level. In this regard, the optical scanner may be located on the sidewalls of the container or have a position suspended from a sidewall and be positioned within the container. The CPU receives input from the coin acceptor or coin switch 67. When a predetermined amount of money or tokens is detected, the game is activated and a player may manipulate joystick 65. Manipulation of the joystick allows the player to operate Y travel stepper motor 501 and X travel stepper motor 502 as well as rotate claw motor 360 for a predetermined amount of time. When the time has elapsed, the claw up/down motor or reel motor 304 is activated to lower the claw. At the same time, the CPU causes air valve 609 to close to force the piston 605 from cylinder 603 and open the claw.

Figure 9:
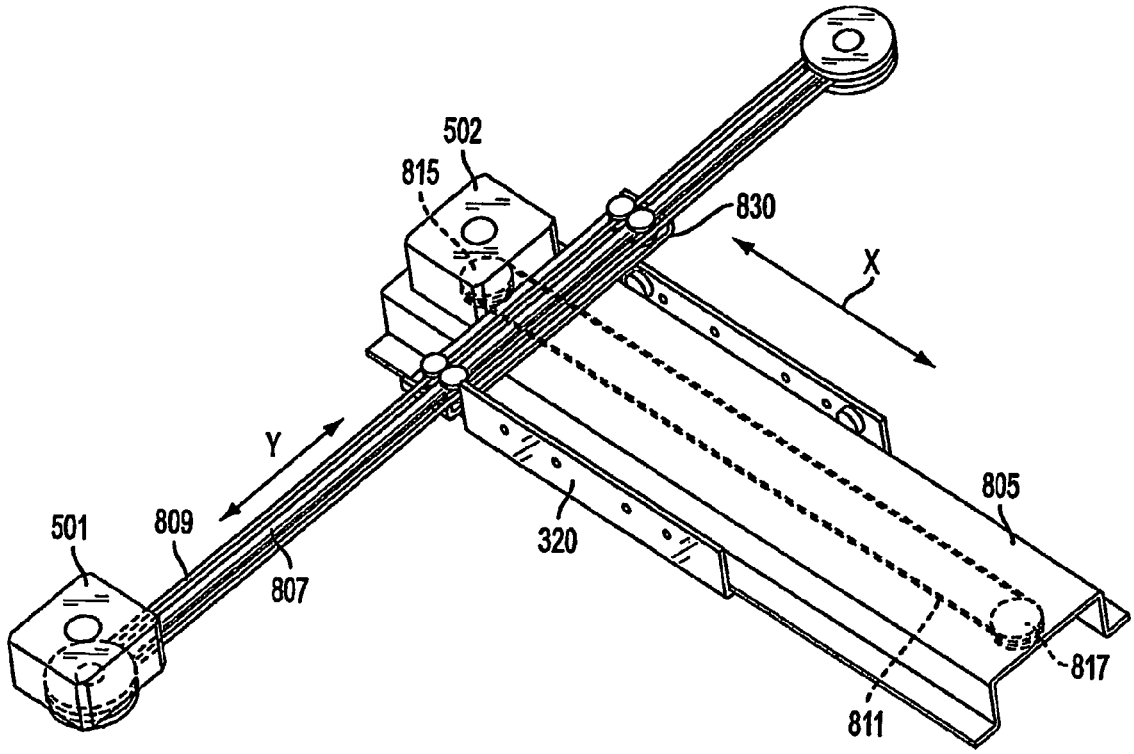
FIG. 9 is a perspective view of the tracks on which the claw is mounted.
Figure 10:
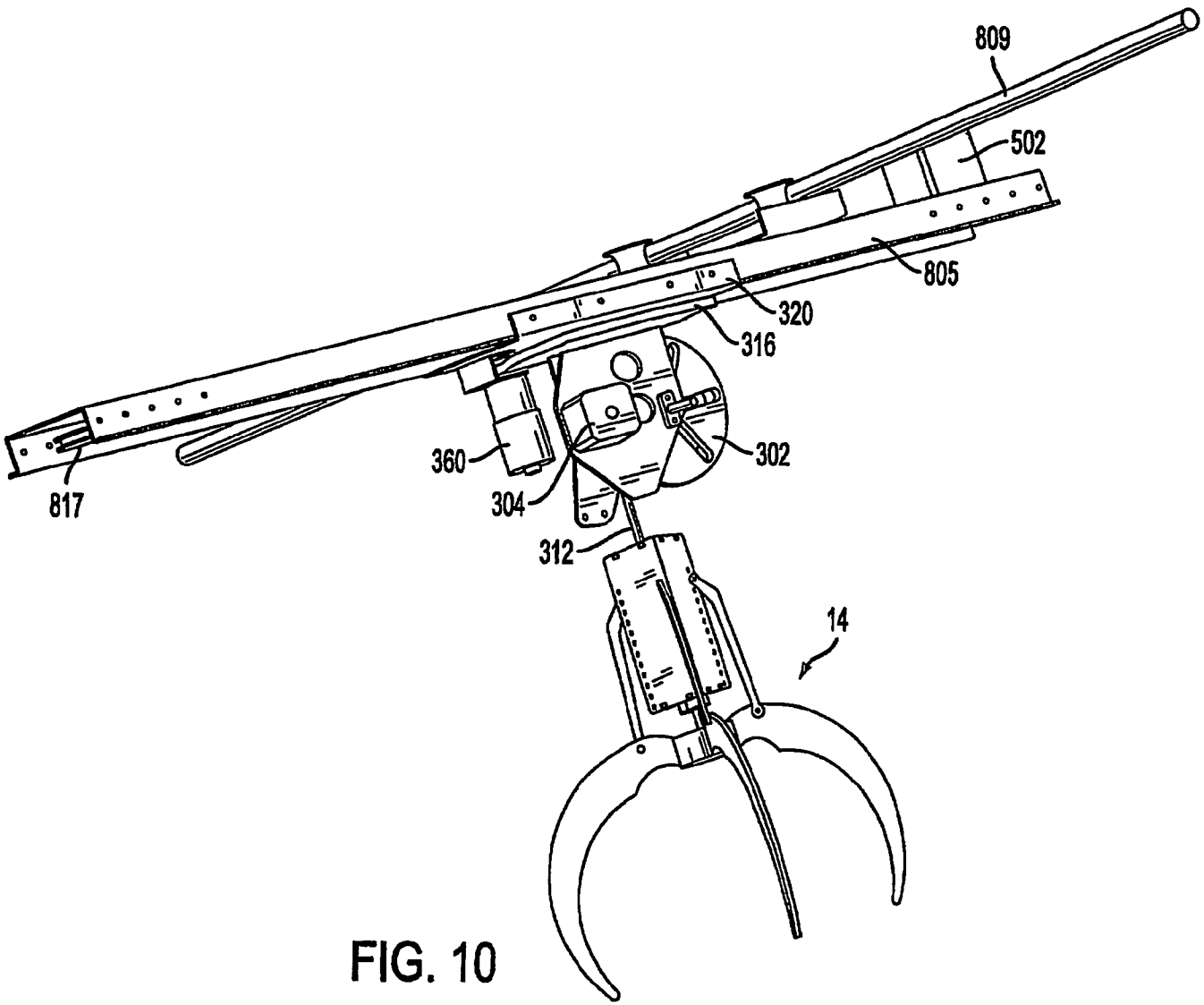
FIG. 10 is another view in perspective of the tracks on which the claw is mounted.

Now referring to FIG. 9 the claw 310 is suspended over the play field 12 from carriage 320 that is mounted on the first track 805 that traverses the play field area in a first direction. First track 805 is mounted on a second track 807 that is oriented perpendicular to the first track. Carriage 320 is attached to a drive belt that is mounted on first track 805. A first wheel 815 is driven by the shaft of motor 502. An endless drive belt 811 is driven about opposite hub 817 also located on track 805. The signals that actuate motor 502 and 501 are sent from the CPU in response to input generated from movement of the joystick 65 that in turn allow the carriage to be moved in X and Y directions. In an alternative of the invention, a button may be used to lower the claw in the vertical or "Z-direction" rather than have motor 304 be actuated by the CPU after the elapse of a predetermined time. The carriage 320 is secured to one side of drive belt on a first horizontal track member which can move in response to operator control in a lateral direction along the length of the horizontal member. The first horizontal track 805 is attached to second horizontal track member 807 by bracket 830 that enables the entire horizontal track 805 to travel in a direction perpendicular to the second track 807 in response to operator control. Movement of the track member 805 is effected by endless belt 809. This arrangement allows an operator to position the claw at any location within a plane defined by the first and second members. On opposite ends of track 805 is free spinning hub 817 on which an endless drive belt is connected. The bracket is attached to one side of the drive belt. As the motor 502 drives wheel 815, the belt 811 moves around the wheel and hubs. Since the carriage is attached to one side of the belt 811, the claw will move along the track in response to movement of the drive belt. The first track member 805 is attached to second horizontally oriented member 807 which enables the first horizontal track member to travel in a direction perpendicular to the second member in response to operator control. This arrangement allows an operator to position the claw at any location within a plane defined by the first and second tracks.

In use, the operator attempts to exercise his skill to directly align the claw over a desired prize. When the player is satisfied with the location of the claw, or after a predetermined time has elapsed, the claw is dropped along a third vertical axis toward play field 12. If the player has accurately aligned the claw over the selected prize the claw may close and potentially engage the object. Any item that is successfully lifted is then transported from the play field through chute 17 to the retrieval area 18 that can be accessed by the player.

The use of stepper motors in the invention provides a number of advantages over the prior art. Stepper motors allow a player to accurately control the travel of the claw on the suspended tracks and the rotation of the claw—thereby enhancing the play. Further, stepper motors may be operated forward and backward without the use of multiple switches. The stepper motor has permanent magnets attached to it and around the motor is a series of coils that create a magnetic field that interacts with the permanent magnets. When these coils are turned on and off, the magnetic field causes the rotor to move. As the coils are turned on and off in a certain sequence the motor will rotate forward or reverse. To run the stepper motor the CPU constantly turn on and off the coils. Because steppers can be controlled by turning on and off coils, they can be easily controlled using computers. The computer is programmed to energize the coils in a certain pattern that results in the movement of the motor. Importantly, at any given time, the computer will know the precise position of the motor since the number of steps can be stored in the CPU. For further accuracy, an optical encoder can be attached to the shaft to verify the position of the motor. In conventional DC motors, in order to change the direction of the travel a switch has to be provided to reverse the direction of current to the motor. The use of stepper motor reduces the number of switches required in the device and allows for the precise detection of any device that is coupled to the motor. In an alternative to using stepper motors for the X and Y positioning, or the other motors, some of these same advantages can be achieved by encoding the shaft of a conventional DC motor and detecting the code. By encoding and detecting the code, the position of the motor may also be accurately stored by the CPU and consequently, the position of any apparatus coupled to the motor can also be determined. The detection can be performed using an optical sensor wherein a digital signal is generated from the shaft which is then transmitted to a CPU for processing. Accordingly, in an alternative embodiment of the invention, DC motors are employed that have encoded shafts wherein the position of the motor can be accurately tracked.

Figure 8A:
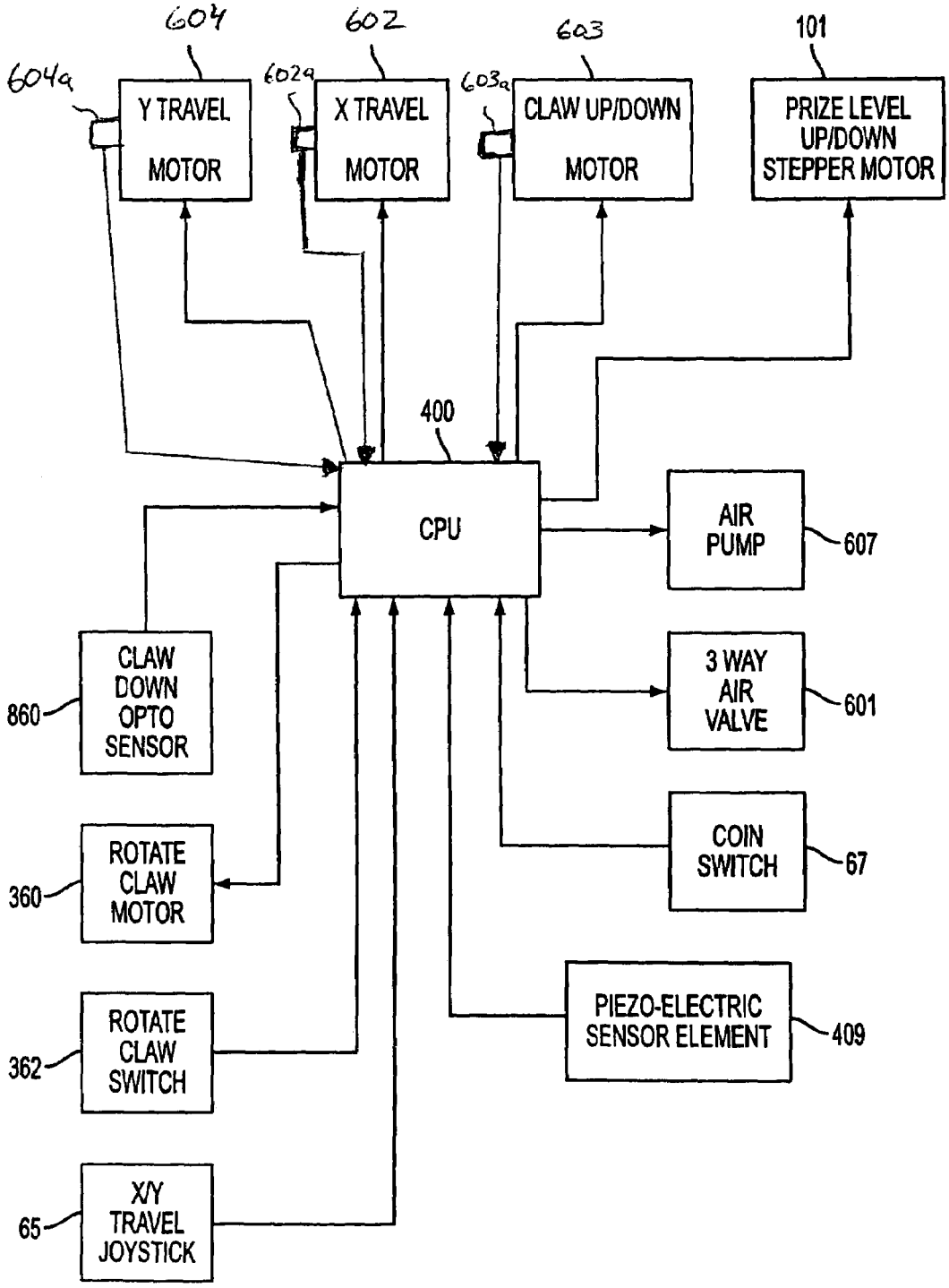
FIG. 8*a* is a schematic drawing depicting an alternative embodiment of the invention.

Referring to FIG. 8*a*, in an alternative embodiment of the invention. DC motors X 604 Y 602 and Z 603 are employed that have encoded shafts 604*a*, 602*a* and 603*a* wherein the position of the motor can be accurately tracked.

A further feature of the present invention is a quit feature. In prior art crane games, in the event that a player did not win a prize, the game would nevertheless progress wherein the engagement device (or claw) would return to the retrieval location and open the engagement device over the retrieval area before the shutdown procedure. In accordance with an additional feature of the invention, a signal is sent to the CPU when a prize is successfully engaged by claw 14. In a preferred embodiment the increase in weight of the claw assembly is sensed by a piezo-electric sensor element 409, wherein a signal is generated and transmitted to the CPU. When the piezo-electric element is subjected to differences in stress or force, current through the piezo-electric element is caused to flow (or is altered). These current changes are converted to a signal which is transmitted to the CPU and reflects that the claw has engaged a prize and thereby has additional weight. In the event that the claw does not successfully engage a prize no signal is received (or a different signal is received). If the CPU samples the input from the piezo-senor after the claw engagement sequence has been initiated and does not receive the signal reflecting a successful engagement of the prize, the CPU will activate a credit button, that can be then pressed by the player if sufficient credits have been registered. Pressing the credit button will then initiate a new play of the game. This game condition may be communicated to the player by the illumination of a light in or near the credit button. Accordingly, as soon as it is apparent that the attempt to engage a prize was unsuccessful, a new game sequence may be initiated wherein, upon activation of the credit switch, the joystick and other player controls are again activated and the game begins a new countdown sequence. This "rapid play" feature enables a player to quickly continue play of the game and avoids the frustrating sequence wherein a claw, devoid of a prize, proceeds to travel to the retrieval area and open the empty claw.

In an alternative embodiment the signal that a prize has been won is sensed by a pressure sensitive switch located in assembly 300—similar to the claw sensing optical sensor. In the event that the weight of the assembly displaces a spring past a predetermined distance, a signal is generated and transmitted to the CPU. Such a signal can be generated by an optical sensor wherein a light beam may impinge on a photo detector when the assembly displaces a spring past a predetermined distance or by a pressure activated switch.

In use, the operator attempts to exercise his skill to directly align the claw over a desired prize. When the player is satisfied with the location of the claw, or after a predetermined time has elapsed, the claw is dropped along a third vertical axis toward the play field. If the player has accurately aligned the claw over the selected prize the claw will drop and potentially engage the object. When the claw has engaged the prizes on the play field, a signal is generated and transmitted to the CPU indicating that the claw is at the bottom of the play field.

The operation of the device is controlled by a central processing unit ("CPU") or controller 400 schematically depicted in FIG. 8 which has a multi-task operating system so that the central processing unit can in effect perform several different tasks simultaneously. These tasks include a coin detection task which responds to a coin switch being closed in response to a genuine coin being inserted into the coin slot, a prize detection task, which responds to a signal from a prize detection sensor located in chute 17. The CPU will also respond to shifts in voltage from each the respective motors which reflect that further motion in the direction has been impeded.

Play of the game proceeds when a player inserts a token or coin into the coin acceptor mechanism 67. Upon the introduction of a coin or token into a conventional coin acceptor the acceptor determines if the coin is genuine and either rejects the coin and returns the coin to the coin return or accepts the coin and sends a signal to CPU 400. When the predetermined monetary value for operation of the device has been met, a credit switch is activated. When the credit is depressed by the player, the CPU activates joystick controller 65 for stepper motors 501 and 502. Switches 69 and 70 that control claw orientation stepper motor 360 are also activated. An internal timer contained within CPU 400 is also activated which counts down a predetermined time when the joystick controller 20 is activated. Input from the joystick controller to the CPU is processed and converted to output for stepper motor 501 and stepper motor 502 causing the carriage 320 to move on the grid formed by tracks 805 and 807. After the predetermined time has elapsed, or, upon engagement of a Z claw drop switch (not shown), reel motor 304 is activated which drives reel 302 thereby unwinding hose 312 and causing the claw 310 to move toward play field 12. At times controlled by the CPU 400 motor 101 is activated to elevate the play field floor 12.

Another feature of the invention causes the reel motor 304 to be activated at predetermined times as part of a maintenance procedure. This procedure is intended to address the problem when the prizes have settled and/or have nested together. At the end of a day or at another predetermined time, or in response to an input command by the operator, the claw is systematically moved to numerous positions on the grid over the play field formed by tracks 805 and 807. At each pre-selected location, the claw drops, engages any prizes on the prize field and then lifts the prizes straight up and opens the claw to release any prize that may have been engaged. This procedure serves to make the distribution of the prizes across the play less dense and results in an appearance where the container looks like it is full of prizes. This procedure, which is most useful when plush items are used as prizes, may be programmed to be initiated when the game is turned off or upon the initiation of the game.

While this invention relates to coin operated devices, this term "coin operated" is meant to encompass a variety of manners to allow customers to play the game including but not limited to coins, currency, tokens, debit cards, credit cards, or any other way in which to transfer funds from the player to the owner of the machine in return for the opportunity to play the game.

As the prizes are removed from the container, the level of the prizes remaining in the containers is reduced and the level will gradually lower. However, in response to the level of prizes in the container section 10 being lowered, the play field floor of the container section 10 is raised thereby maintaining a relatively constant level in the container. A signal is sent from a processor 400 to the motor 101 in response to a sensing that the prize level has dropped by the sensor.

It should be apparent by the foregoing description that the present invention achieves the intended goals. For example, using the vertically movable play field feature enables the owner of the device to restock the game less frequently. The maintenance sequence evenly distributes the prizes and mitigates the problems with settling and nesting of the prizes. Play of the machine is more enjoyable because the player has better control over the orientation of the claw with respect to the play field. The air-powered claw is more reliable and the performance of the claw may easily be adjusted by the operator by controlling the pressure.

The above description is of preferred embodiments of the invention and modifications may be made thereto without departing from the spirit and scope of the invention which is defined in the appended claims.

The invention claimed is:

1. A coin operated amusement device comprising:

a container for storing a plurality of prizes, said container having a transparent window area, a play field surface for supporting said plurality of prizes;

an engagement device for engaging said prizes and transferring said prizes to an area that is accessible to a player, said engagement device comprising a controller for orienting an engagement means at a desired location and for activating said engagement means for engaging and disengaging prizes at predetermined times, user input means for controlling the position of the engagement means over a play field, and play field elevation means for moving the play field vertically within said container.

2. The amusement device recited in claim 1 wherein the play field elevation means comprises a drive system including a motor, a nut having internal threads, a rod having opposite threads received in said nut, said nut being coupled to said motor to rotate said nut causing said threaded rod to move when said motor is actuated, the rotation of the threaded nut imparting a linear movement to said threaded rod and said threaded imparting a driving force on said play field a the vertical direction.

3. The amusement device recited in claim 2 further comprising motor controlling means for actuating the motor that moves the play field in response to predetermined criteria.

4. The amusement device recited in claim 3 further comprising a sensor for indicating when the level of prizes in the container are diminished below a predetermined level, and wherein the motor controlling means actuates the motor that moves said play field to raise said play field in response to a signal from said sensor that indicates when the prize level has decreased below said predetermined level.

5. The amusement device of claim 4 wherein the motor controlling means actuates the play field adjustment motor after a predetermined number of times that a prize has been awarded.

6. The game amusement device of claim 1 wherein said engagement device comprises a claw member suspended from an overhead track.

7. An improved amusement device having a plurality of prizes in a container and a claw for extracting the prizes, the improvement comprising:

a system for opening and closing arms of an engagement device, said system comprising a an air pump, a hose connecter to said air pump and an air cylinder, said cylinder having a chamber having an displaceable end wall, said end wall connected to a piston, and said a piston in engagement with a control member, said control member in engagement with said arms in manner to allow for the application of force on said proximate end, wherein said arms will pivot on a point and move in response to said force on said proximate end, and a valve for releasing pressure in the system and control means for the controlling the opening and closing of said value at predetermined times.

8. An improved crane amusement device having a plurality of prizes on a play field in an enclosed container and an engagement device for extracting said prizes, wherein said engagement device is suspended over said prizes and is lowered on a z axis to engage said prizes, and a player can control the location of said engagement device on an X and Y axis, said improvement comprising, providing input relating to the location of said engagement device to a processing unit, wherein said processing unit can track the location of said engagement device on X Y and Z axes, and wherein said input is provided by an encoded shaft on motors that drive said engagement device in an X Y and Z direction and optical sensors, said optical sensors providing output signals in response to reading the matter encoded on said motor shafts, and said signals transmitted to a processing unit for processing.

* * * * *